United States Patent [19]

Knoop

[11] Patent Number: 4,805,304

[45] Date of Patent: Feb. 21, 1989

[54] UTILITY KNIFE HAVING A SLIDING BLADE HOLDER

[75] Inventor: Heinz-Peter Knoop, Solingen, Fed. Rep. of Germany

[73] Assignee: D. G. S. Research & Development, Haifa, Israel

[21] Appl. No.: 65,331

[22] Filed: Jun. 22, 1987

[30] Foreign Application Priority Data

Jul. 3, 1986 [DE] Fed. Rep. of Germany ..... 3622342

[51] Int. Cl.[4] ..... B26B 1/08

[52] U.S. Cl. ..... 30/162; 30/335

[58] Field of Search ..... 30/162, 163, 335, 336, 30/320

[56] References Cited

U.S. PATENT DOCUMENTS

| | | | |
|---|---|---|---|
| 1,507,043 | 9/1924 | Blow | 30/162 |
| 2,304,332 | 12/1942 | Bodkin | 30/335 |
| 2,640,260 | 6/1953 | Taylor et al. | 30/162 |
| 3,906,627 | 9/1975 | Manning | 30/162 |
| 4,517,741 | 5/1985 | Castelluzzo | 30/162 |

FOREIGN PATENT DOCUMENTS

| | | |
|---|---|---|
| 2736395 | 2/1978 | Fed. Rep. of Germany . |
| 2704019 | 3/1978 | Fed. Rep. of Germany . |
| 1511889 | 5/1978 | United Kingdom . |
| 2085790 | 5/1982 | United Kingdom . |

*Primary Examiner*—Douglas D. Watts

*Attorney, Agent, or Firm*—Herbert Dubno

[57] ABSTRACT

The knife comprises a substantially hollow handle, a knife blade guided longitudinally movable in a knife blade guide track and at least one guided slider member coupled indirectly with the handle end of the longitudinally movable knife blade. A slider longitudinal slot which receives the slider member extends across the entire thickness of the handle. The slider member has an operating piece on each handle broad side. Both operating pieces receive between themselves at least one guide strip extending parallel to the handle longitudinal axis. The knife blade is held between both operating pieces. The knife blade is so structured that an ergonomically beneficial thumb operable slider mechanism operation is provided for a variety of working situations in a simple way.

16 Claims, 5 Drawing Sheets

UTILITY KNIFE HAVING A SLIDING BLADE HOLDER

CROSS REFERENCE TO RELATED APPLICATION

This application is relative to my copending application Ser. No. 09/065,337 field June 22, 1987 which is hereby incorporated by reference herein.

FIELD OF THE INVENTION

My present invention relates to a utility knife and, more particularly, to a safety knife with a substantially hollow handle.

BACKGROUND OF THE INVENTION

A knife with a substantially hollow handle is described in U.S. Pat. No. 2,862,296. The knife has a knife blade guided longitudinally movable in a knife blade guide track and at least one slider member coupled with the handle side of the longitudinally movable knife blade. The slider member penetrates a wall of the handle in a slider member longitudinal slot in the handle broad side.

This knife has an operating piece designed for thumb operation and located only on one handle broad side. Also it is oriented for certain particular manipulations and cannot be conveniently shifted from hand to hand.

OBJECTS OF THE INVENTION

It is an object of my invention to provide an improved utility knife, particularly a knife which overcomes drawbacks of earlier knives.

It is also an object of my invention to provide an improved knife, particularly a safety knife, which is more easily universally operable or serviceable than previously, i.e. can be used equally well by right and left hand users.

SUMMARY OF THE INVENTION

These object and others which will become more readily apparent hereinafter are attained in accordance with my invention in a knife with a substantially hollow handle comprising a knife blade guided longitudinally movable in a knife blade guide track and at least one guided slider member coupled with the handle side of the longitudinally movable knife blade. The slider member penetrates a wall of the handle in a slider member longitudinal slot in the handle broad side.

According to my invention the slider longitudinal slot extends across the entire thickness of the handle, i.e. opens at both broad sides.

The slider member has on each of the handle broad sides an operating piece engageable by a thumb. Both of the operating pieces receive between themselves and the knife blade at least one guide strip extending parallel to the handle longitudinal axis.

Essentially, the slider longitudinal slot extends across the entire thickness of the handle. Thereby an operating piece can be provided on each handle broad side in a knife with a simple structure.

Especially with a safety knife whose blade is spring loaded for retraction, a continuous thumb operation of the operating pieces is possible even in overhead cutting work. Understandably the knife equipped according to my invention is equally suitable for both right and left handed persons.

Both operating pieces are guided on at least one longitudinal guide strip. The one or more guide strips are positioned between the pair of operating pieces and receive therebetween the knife blade—advantageously detachably.

Advantageously, both of the operating pieces are formed and positioned during normal operation in a mirror image symmetrical configuration with respect to a symmetry plane extending substantially parallel to the plane of the knife blade.

In a particularly desirable embodiment of my invention the inside of the handle has a guide strip on each long side of the slider longitudinal slot. The slider member is divided approximately in a plane extending between the two guide strips and each of two slider member portions so formed are connected with one other. Each one of the slider member portions is fitted with one of the operating pieces.

Both of the slider member portions are connected with each other detachably or rigidly. Both of the slider member portions can be connected with each other detachably by snap lock means.

Further, in this embodiment both of the guide strips have a substantially flat rectangular cross section. One of the slider member portions can comprise a slider plate with two peripheral strip like slider regions parallel to the plane of the knife blade for contact on a strip lateral surface parallel thereto. Connected to the slider regions is a guiding extension located in one of the intermediate spaces between both of the parallel spaced guide strips. The guiding extension contacts with guiding surfaces running transverse to the plane of the knife blade on parallel inner strip surfaces of the guide strips.

Further, a receptacle for the knife blade can be provided on the broad side of the slider plate facing away from the guiding extension.

The slider plate adjacent the receptacle for the knife blade can have a pivot joint with the operating piece. Advantageously the pivot joint is a film frame hinge joint.

The other one of the operating pieces on the other one of the handle broad sides facing away from the receptacle for the knife blade is contrastingly attached releasably on the guiding extension and contacts with two peripheral strip like slider regions parallel to the plane of the knife blade on a plurality of strip lateral surfaces parallel with the slide regions.

The front end of a tension providing spring can be attached to the rear end of the slider member facing away from the cutting end.

The rear end of the spring is attached to an at least partially roll like insertable body which penetrates the handle. This handle comprises two handle longitudinal halves. A transverse opening in the handle is shaped to allow press fitting thereinto of the insertable body.

The insertable body can have an extension bounding the slider longitudinal slot rearwardly in one of the handle broad sides. This extension fills a receiving slot connected to the longitudinal slot rearwardly and which forms a gutter like receiving duct, for the tension providing spring, opening interiorly into the hollow handle. The guide strips can be formed on the handle longitudinal half facing away from the receptacle for the knife blade. Both of the operating pieces with the knife blade pushed into the cutting position can be located adjacent the cutting end of the handle. These operating pieces form two concave gripping surfaces curving out from the knife blade toward the cutting end.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
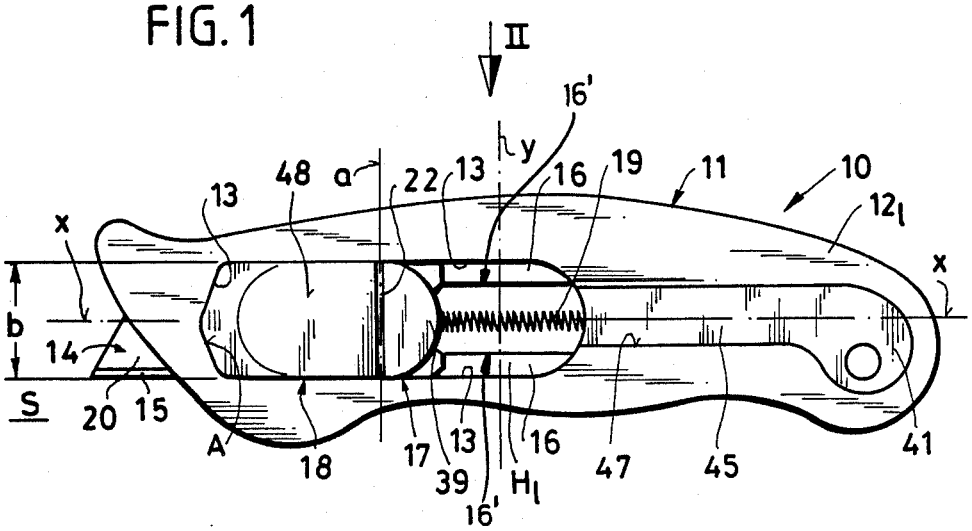
FIG. 1 is a side elevational view of the broad side of a knife according to my invention with knife blade in outwardly extended position.

The knife as a whole is indicated at 10.

Each knife 10 has a substantially hollow handle 11 which comprises two handle longitudinal halves $12_l$ (left handle longitudinal half) and $12_r$ (right handle longitudinal half).

A slider longitudinal slot 13 which extends across the entire thickness of the handle 11, i.e. from the left broad side $B_l$ to the right broad side $B_r$, is located in each broad side of the handle 11, thus in the left broad side $b_l$ and the right broad side $B_r$. The slider longitudinal slot 13 is divided into two longitudinal slot halves and of course into the left longitudinal slot half $H_l$ and the right longitudinal slot half $H_r$ as is apparent from FIGS. 4 and 5.

The width b of the left longitudinal slot half $H_l$ is somewhat larger than the width of the knife blade 14, in the present case a trapezoidal blade, with a cutting edge 15.

The handle longitudinal half $12_r$ visible except in FIG. 1 forms two knife blade guide tracks 16' located spaced parallel from each other on which the knife blade 14 is guided longitudinally slidable parallel to the handle longitudinal axis x through indirectly by a slider member indicated as a whole with the reference character 17.

Figure 2:
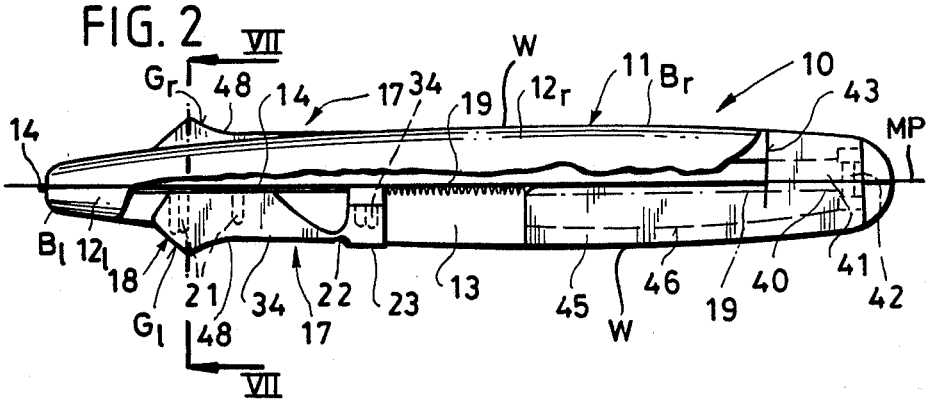
FIG. 2 is a top plan view of the knife viewed in the direction of the arrow indicated with II in FIG. 1 with the handle longitudinal halves shown partially cutaway.

The knife blade guide tracks 16' which form the guide strips 16 for the slider 17 are described in more detail in the following:

In FIGS. 1 and 2 the knife blade 14 is located in its cutting position, i.e. the slider 17 is entirely pushed forwardly to the cutting end indicated with S. A slider cover 18 approximately V-shaped upon side view, can be pushed up to a correspondingly formed stop A of the left slider longitudinal slot half $H_1$.

The longitudinal sliding of the slider 17 forwardly to the cutting end S occurs opposing the restoring force of a tension providing spring 19. With this safety knife 10 the operating thumb must also hold the slider 17 continuously in its cutting position.

Of course, the locking means are usable for the cutting position which for example according to German Patent No. 27 36 395 maintains the knife blade in the cutting position with comparatively little thumb transverse force.

As soon as the slider cover 18, forming simultaneously a left operating piece $G_1$, is not longer pushed forward with the thumb the tension providing spring 19 also pulls the slider 17 together with the knife blade 14 back into a retracted position in which the knife blade can be removed entirely from the handle 11. Then the knife blade 14 is located with its entire knife broad side 20 inside the left slider longitudinal slot half $H_1$.

Figure 3:
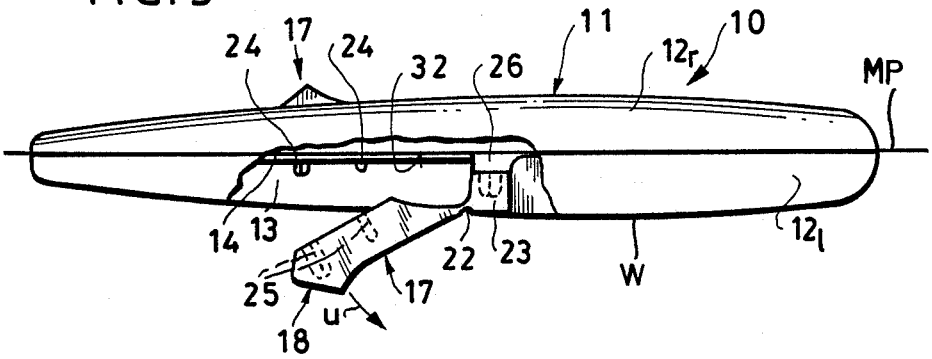
FIG. 3 is a top view supporting the illustration in FIG. 2 however with the slider cover swung out.

The removal of the knife blade 14 is completed in its retracted resting position according to FIG. 3.

First the knife blade 14 is held releasably locked in its pushed in cutting position inside of the slider member 17 corresponding to the illustrated position. The releasable locking occurs by the snap lock means 21 which are illustrated with dashed lines in FIG. 2.

After the tension providing spring 19 has become effective to retract the blade, the knife blade 14 together with the slider 17 are located in the retracted resting position according to FIG. 3.

Since the slider cover 18 or the left operating piece $G_1$ is held on a knee piece 23 and this again is held on a slider plate 26 the slider cover may be released from the snap lock means 21 with a pivot motion u. Thus the knife blade 14 can be taken out through the broad left slider longitudinal slot half $H_1$ and a new knife blade can be substituted for it.

From FIG. 3 it is apparent that the snap lock means 21 may be in the form of centering pins 24 attached to the slider plate 26 which pins mate with locking recesses 25 located in the slider cover 18.

As soon as a new knife blade 14 is substituted, the slider cover 18 is shifted again into its locking position (compare with FIGS. 1 and 2).

It should be mentioned that the joint axis a of the film frame joint 22 extends parallel to the transverse axis y of the handle 11.

Illustrated slider member 17 and the film frame joint 22 are appropriately die cast or injection molded from a plastic material. Both handle longitudinal halves $12_l$ and $12_r$ can be produced by either plastic die casting or injection molding or metal casting.

Figure 4:
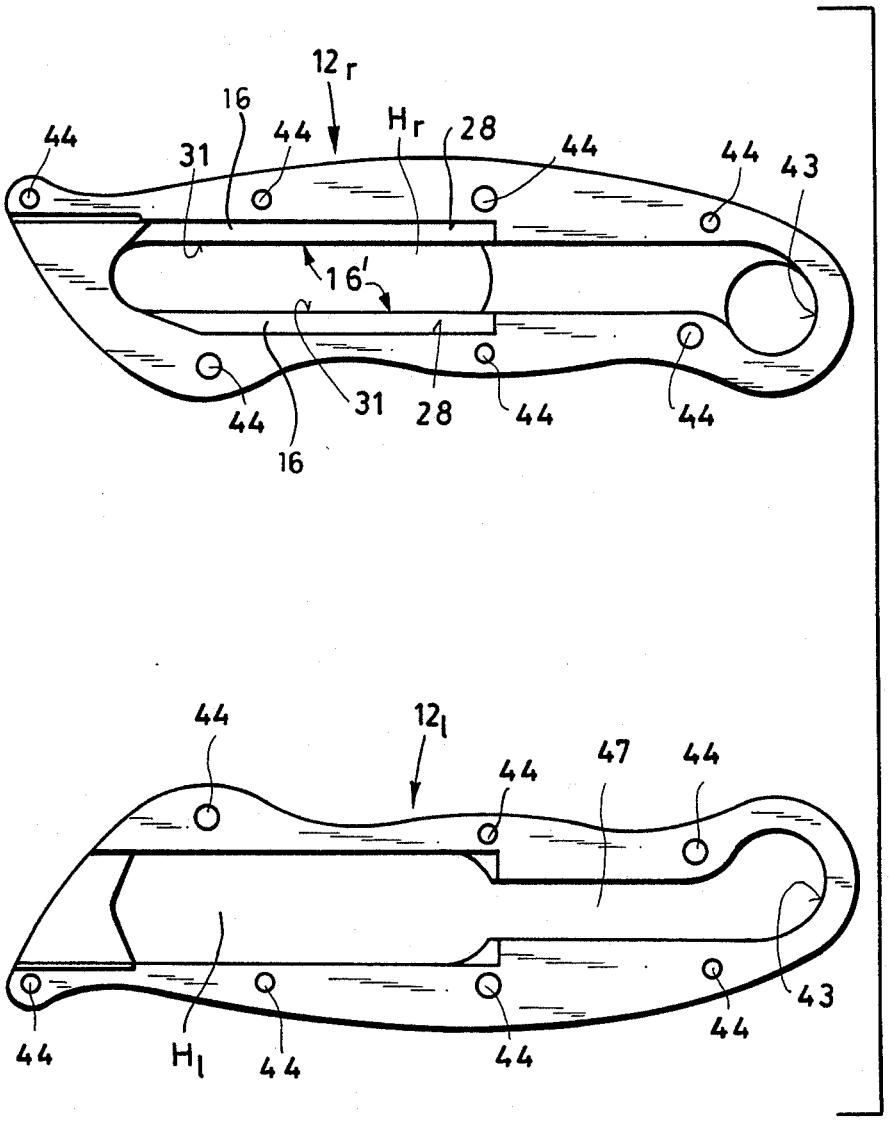
FIG. 4 is an upper side elevational view of the inner side of the right handle longitudinal half and a lower side elevational view of the inner side of the left handle longitudinal half according to FIGS. 1 to 3.
Figure 5:
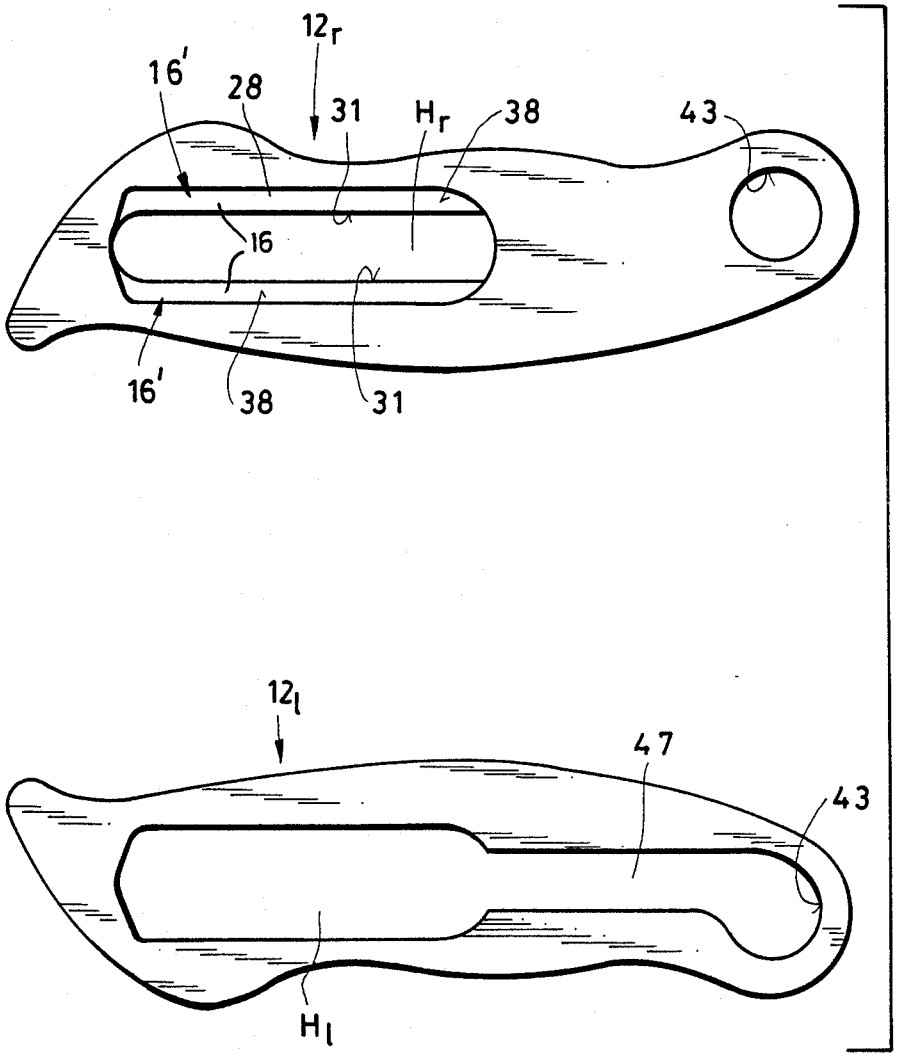
FIG. 5 is an upper side elevational view of the outside of the right handle longitudinal half and a lower side elevational view of the outside of the left handle longitudinal half (the latter is the viewing direction in FIG. 1)
Figure 6:
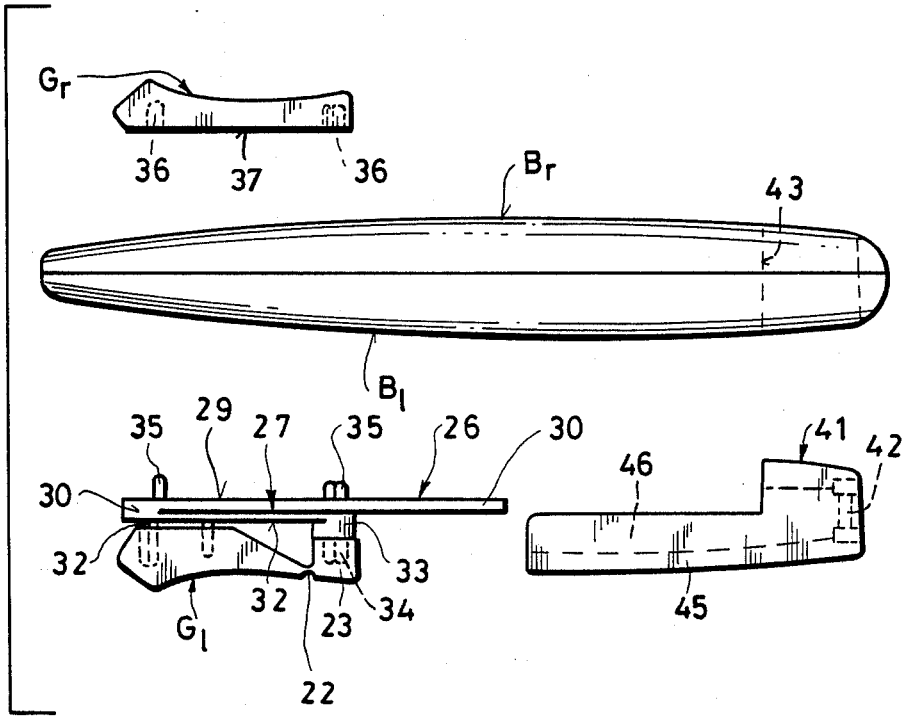
FIG. 6 is a top plan view of the disassembled interior movable components of the knife wherein the components have been pulled laterally from the knife.

The structure of the slider member 17 can be further understood with the aid of FIGS. 4 to 6. From FIGS. 1 to 3 it is apparent that the slider longitudinal slot 13 penetrates transversely the entire thickness of the handle 11 and that the slider member in the slider longitudinal slot 13 has a transverse cross section such that it forms a left operating piece $G_l$ on the left handle broad side $B_l$ and a right operating piece $G_r$ on the right handle broad side $B_r$.

Thus both operating pieces $G_l$ and $G_r$ are positioned in a mirror image symmetrical configuration with respect to a mirror plane MP extending substantially parallel to the plane of the knife blade 14.

Of course this symmetry is preserved only during normal operation when one of the operating pieces is not swung out for replacement of the knife blade.

A particular characteristic of the slider member and the handle side guide arrangement is that the handle 11, and of course the right handle longitudinal half $12_r$, inwardly on both sides of their longitudinal slot halves $H_r$, i.e. on their upper and their lower longitudinal side, each have guide strips 16 (see FIGS. 4 and 5 of the upper illustration). The slider member 17 is divided now approximately by a plane extending between both these guide strips 16.

Both slider member portions so formed which are associated with the operating pieces $G_l$ and $G_r$ are attached with each other rigidly or detachably.

In FIG. 6 both slider member portions of the slider 17 with the left operating piece $G_l$ and the right operating piece $G_r$ are particularly clearly illustrated.

The slider member portion with the operating piece $G_l$ is provided with a slider plate 26. The slider plate 26 has two peripheral strip like slider regions 27 parallel to the plane of the knife blade 14 of which only one is apparent in FIG. 6. Both slider regions 27 are designed for contacting or bearing on the guide strips 16 on their parallel strip lateral surfaces 28 (see FIG. 4 upper illustration).

Centrally between both strip like slider regions 27, the slider plate 26 has a guiding extension 29 which has lower and upper guiding surfaces 30 (from FIG. 6 only the upper guiding surface 30 is apparent) running transverse to the plane of the knife blade 14 contacting on parallel inner strip surfaces 31 of the guide strips 16.

At the same time the slider plate 26 has a receptacle 32 for the knife blade 14 in its broad side spaced from the guiding extension 29.

The slider plate 26, has adjacent its knife blade receptacle 32, a shoulder 33 on which roll like locking pins 34 are carried which snap lock into undercut locking recesses of the supporting knee 23 not illustrated in detail.

In the right handle broad side $B_r$ the guiding of the slider 17 is as follows: from FIG. 6 it is apparent that the guiding extension 29 has roll like locking pins 35 directed to the right handle broad side $B_r$. The locking pins 35 are snap locked together with locking recesses 36 inside the right operating piece $G_r$. In this way the right operating piece $G_r$ can form two peripheral strip like slider regions 37 parallel to the plane of the knife blade 14 (from FIG. 6 only one slider region 37 is apparent) which contact on the other strip lateral surfaces 38 parelleling it which are apparent from FIG. 5 (upper illustration).

In the unit shown in FIGS. 1, 2 and 6 it is seen that the front end 39 of the tension providing spring 19 is attached to the rear end of the slider member 17 facing away from the cutting end S (and of course releasably inside of the locking joint between 33 and 34 on a pin not shown in FIG. 6). The rear end 40 of the tension providing spring 19 is attached inside of a partially roll shaped insertable body 41 and of course by a transverse pin 42 shown with dashed lines (FIG. 6).

The partially roll shaped insertable body 41 penetrates both handle longitudinal halves $12_l$ and $12_r$ in a press fit in a transverse opening 43 fitting its outer contour. In this way a stable releasable socket connection is attained at least in the rear portion of the handle 11 which is made up by locking connections provided in the vicinity of the handle longitudinal halves $12_l$ and $12_r$.

The partial roll shaped insertable body 41 has an extension 45 bounded in the left handle broad side $B_l$ and directed rearwardly through the left slider longitudinal half $H_l$. The extension 45 is penetrated axially by a receiving duct 46 for the tension providing spring 19 extending parallel to the handle longitudinal axis. This extension 45 sits in place in a receiving slot 47 (of the handle longitudinal half $12_l$) which is a constricted extension of the longitudinal slot half $H_l$.

Figure 7:
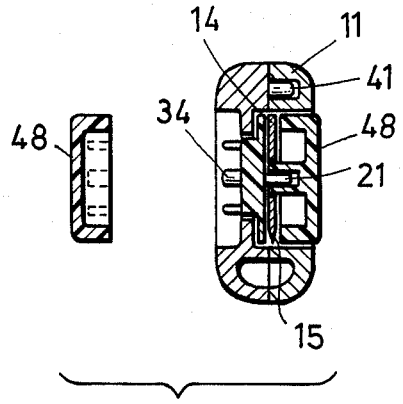
FIG. 7 is a cross-sectional view taken along the axis VII—VII of FIG. 2.

Both operating pieces $G_l$, $G_r$ are positioned with knife blade 14 positioned adjacent the cutting end (S) of the handle and form two concave gripping surfaces members 48 curving out from the knife toward to the cutting end S. FIG. 7 provides a cross-sectional view through gripping surface member 48 and illustrates the interlocking mechanism between the various pins, insertable bodies, and recesses.

Together slider side snap lock locations—with the exception of snap lock location 21—can be undetachably provided during the assembly (e.g. by gluing).

I claim:

1. In a knife with a substantially hollow handle aligned along a longitudinal axis comprising a knife blade, having a broad side, guided longitudinally movable in a knife blade guide track and at least one guided slider member coupled with the broad side of said longitudinally movable knife blade, said slider member penetrating a wall of said handle in a slider member longitudinal slot in a handle broad side, the improvement wherein said slider longitudinal slot extends across the entire thickness of said handle, said slider member has an operating piece on each of said handle broad sides, there is at least one guide strip extending parallel to said handle longitudinal axis, said at least one guide strip being received between both of said operating pieces said knife blade is held between both of said operating pieces, said guide strips are provided inside of said handle and one guide strip is on each long side of said slider longitudinal slot, said slider member is divided approximately in a plane extending between both of said guide strips and each of two slider member portions so formed are connected with each other, of which each one has one of said operating pieces.

2. The improvement according to claim 1 wherein both of said operating pieces are formed and positioned during normal operation in a mirror image symmetrical configuration with respect to a symmetry plane extending substantially parallel to a plane of said knife blade.

3. The improvement according to claim 1 wherein both of said slider member portions are connected with each other detachably or rigidly.

4. The improvement according to claim 3 wherein both of said slider member portions are connected with each other detachably by snap lock means.

5. The improvement according to claim 4 wherein both of said guide strips have a substantially flat rectangular cross section.

6. The improvement according to claim 5 wherein one of said slider member portions comprises a slider plate with two peripheral strip like slider regions parallel to the plane of said knife blade for contact on a strip lateral surface parallel thereto and, connected to said slider regions, a guiding extension located in one of the intermediate spaces between both of said guide strips spaced parallel to each other which contact with guiding surfaces running transverse to said plane of said knife blade on parallel inner strip surfaces.

7. The improvement according to claim 6 wherein a receptacle for said knife blade is provided on the broad side of said slider plate facing away from said guiding extension.

8. The improvement according to claim 7 wherein said slider plate adjacent said receptacle for said knife blade has a pivot joint with said operating piece.

9. The improvement according to claim 8 wherein said pivot joint is a film hinge joint.

10. The improvement according to claim 8 wherein the other one of said operating pieces on the other one of said handle broad sides facing away from said receptacle for said knife blade is contrastingly attached releasbly on said guiding extension and contacts with two of said peripheral strip like slider regions parallel to said plane of said knife blade on a plurality of said strip lateral surfaces parallel with said slider regions.

11. The improvement according to claim 10 wherein the front end of a tension spring is attached to the rear end of said slider member facing away from said cutting end, the rear end of said spring being attached to an at least partially roll like insertable body which penetrates said handle comprising two handle longitudinal halves in a transverse opening fitting the exterior contour of said insertable body in a press fit.

12. The improvement according to claim 11 wherein said insertable body has an extension bounding said slider longitudinal slot rearwardly in one of said handle broad sides which fills a receiving slot in said handle connected to said slider longitudinal slot rearwardly and which provides a gutter like receiving duct for said tension providing spring opening interiorly into said inside of said handle.

13. The improvement according to claim 12 wherein said guide strip is formed by said handle longitudinal half facing away from said receptacle for said knife blade.

14. The improvement according to claim 13 wherein both of said operating pieces with said knife blade pushed into said cutting position are located adjacent said cutting end and provide two concave gripping surfaces curving out from said knife blade toward said cutting end.

15. A knife with a substantially hollow handle comprising:

a knife blade, having a broad side, guided longitudinally movable on a knife blade guide track;

at least one guided slider member coupled with the broad side of said longitudinally movable knife blade, said slider member penetrating said handle in a slider member longitudinal slot extending across the entire thickness of said handle;

two operating pieces for said slider member, one on each handle broad side, formed and positioned during normal operation in a mirror image symmetrical configuration with respect to a mirror plane extending substantially parallel to the plane of said knife blade and said knife blade being held between both of said operating pieces; and at least one guide strip being provided inside of said handle on each long side of said slider longitudinal slot, said slider member being divided approximately in a plane extending between both of said guide strips and each of two slider member portions so formed are connected with each other detachably by snap lock means, of which each one has one of said operating pieces.

16. A knife with a substantially hollow handle comprising:

a knife blade, having a broad side, guided longitudinally movable on a knife blade guide track;

at least one guided slider member coupled with the broad side of said longitudinally movable knife blade, said slider member penetrating said handle in a slider member longitudinal slot extending across the entire thickness of said handle;

two operating pieces for said slider member, one on each handle broad side, formed and positioned during normal operation in a mirror image symmetrical configuration with respect to a mirror plane extending substantially parallel to the plane of said knife blade and said knife blade being held between both of said operating pieces;

at least one guide strip being provided inside of said handle on each long side of said slider longitudinal slot, said slider member being divided approximately in a plane extending between both of said guide strips and each of two slider member portions so formed are connected with each other detachably by snap lock means, of which each one has one of said operating pieces, one of said slider member portions comprising a slider plate with two peripheral strip like slider regions parallel to said plane of said knife blade for contact on a strip lateral surface parallel thereto and, connected to said slider regions, a guiding extension located in one of the intermediate spaces between both of said guide strips spaced parallel to each other which contact with guiding surfaces running transverse to said plane of said knife blade on parallel inner strip surfaces of said guide strips, a receptacle for said knife blade being provided on the broad side of said slider plate facing away from said guiding extension, said slider plate adjacent said receptacle for said knife blade having a film frame joint with said operating piece; and the front end of a tension providing spring being attached to the rear end of said slider member facing away from said cutting end, the rear end of said spring being attached to an at least partially roll like insertable body which penetrates both of the two handle longitudinal halves of said handle in a transverse opening fitting the exterior contour of said insertable body in a press fit and said insertable body has an extension bounding said slider longitudinal slot rearwardly in one of said handle broad sides which fills a receiving slot in said handle connected to said slider longitudinal slot rearwardly and which provides a gutter like receiving duct for said tension providing spring opening interiorly into said inside of said handle.

* * * * *

UNITED STATES PATENT AND TRADEMARK OFFICE

CERTIFICATE OF CORRECTION

PATENT NO. : 4,805,304

DATED : February 21, 1989

INVENTOR(S) : Heinz-Peter Knoop

It is certified that error appears in the above-identified patent and that said Letters Patent is hereby corrected as shown below:

On the title page assignee should read

--(73) Assignee: Martor-Ragentax E. H. Beermann KG, Federal Republic of Germany --.

Signed and Sealed this

Twenty-fourth Day of October, 1989

*Attest:*

DONALD J. QUIGG

*Attesting Officer*

*Commissioner of Patents and Trademarks*